US007243609B1

(12) United States Patent
Ansay et al.

(10) Patent No.: US 7,243,609 B1
(45) Date of Patent: Jul. 17, 2007

(54) TELESCOPING BUOYANCY CAPSULE

(75) Inventors: Michael T. Ansay, Johnston, RI (US); Harry Zervas, Lincoln, RI (US)

(73) Assignee: The United States as represented by the Secretary of the Navy, Washington, DC (US)

( * ) Notice: Subject to any disclaimer, the term of this patent is extended or adjusted under 35 U.S.C. 154(b) by 46 days.

(21) Appl. No.: 11/178,024

(22) Filed: Jul. 8, 2005

Related U.S. Application Data

(60) Provisional application No. 60/587,716, filed on Jul. 12, 2004.

(51) Int. Cl.
*B63G 8/28* (2006.01)
*B63G 8/30* (2006.01)
*F41F 3/07* (2006.01)

(52) U.S. Cl. ..... 114/316; 114/32; 89/1.809; 89/1.81

(58) Field of Classification Search ..... 114/316, 114/317, 318, 319, 320; 89/1.809, 1.81
See application file for complete search history.

(56) References Cited

U.S. PATENT DOCUMENTS

| | | | |
|---|---|---|---|
| 3,137,203 | A | 6/1964 | Brown |
| 3,242,810 | A | 3/1966 | LaPointe |
| 4,003,291 | A | 1/1977 | Vass et al. |
| 5,092,222 | A | 3/1992 | Lynch |
| 6,164,179 | A | 12/2000 | Buffman |
| 6,286,410 | B1 | 9/2001 | Leibolt |
| 6,427,574 | B1 | 8/2002 | Callahan |

FOREIGN PATENT DOCUMENTS

| | | |
|---|---|---|
| DE | 39 40 583 A1 | 6/1991 |
| JP | 7318298 | 12/1995 |

*Primary Examiner*—Sherman Basinger
(74) *Attorney, Agent, or Firm*—James M. Kasischke; Michael P. Stanley; Jean-Paul A. Nasser

(57) ABSTRACT

The present invention relates to a capsule sized to contain a weapon for launching and to withstand depth pressures. A telescoping nose section of the capsule, normally unextended around the weapon, extends at launch along a longitudinal axis of the capsule to provide the buoyancy used to lift the capsule out of a stored state and to ascent the capsule towards the surface. Once the surface is reached, a nose cone of the capsule is jettisoned to allow the weapon to exit the capsule.

7 Claims, 5 Drawing Sheets

TELESCOPING BUOYANCY CAPSULE

This application claims the benefit of U.S. Provisional Application Ser. No. 60/587,716, filed Jul. 12, 2004.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention provides a buoyancy capsule sized to contain a weapon for launching. A telescoping nose section of the launch capsule, normally unextended around the weapon, extends at launch along a longitudinal axis of the capsule to provide the buoyancy used to lift the capsule out of a stored state and to ascent the capsule towards the surface. Once the surface is reached, a nose cone of the capsule is jettisoned to allow the weapon to exit the capsule.

(2) Description of the Prior Art

Presently, no weapons/vehicles presently used by the Navy are designed for continuous seawater emersion. Therefore, all existing weapon/vehicles require a protective capsule, especially in the case of aerial missiles and vehicles.

Existing capsules are large in size because the capsules integrate the required buoyancy directly into the large size of the capsule, such that the volume of the capsule is usually much larger than the weapon/vehicle it contains. The larger size is needed to provide the buoyancy force that is necessary to lift the weapon/vehicle out of the payload bay and to carry the weapon/vehicle to the surface.

Protective capsules must also be capable of withstanding the launch depth pressure. However, based on a given capsule wall thickness, a smaller capsule can withstand greater depth pressures than a large one. Therefore, by minimizing the size of the protective capsule, launch depth capability can be improved.

In the Lynch reference (U.S. Pat. No. 5,092,222), a launch system is disclosed. The system is a float-up launching system for launching missiles from submerged submarines utilizing a lightweight rigid cylindrical tube 18 telescoped over the missile 14 (FIGS. 1 and 2) while stored in the launcher so as to not take up additional volume. At launch, the tube 18 is extended forward of the missile 14 by a gas generator 32 to form a floatation chamber 12 (FIGS. 3 and 4) which creates extra buoyancy forward of the missile's center of gravity. At the surface of the water, the floatation chamber 12 is disconnected (FIG. 5) and the missile booster is ignited.

In the Vass reference (U.S. Pat. No. 4,003,291), a launch apparatus is disclosed. The apparatus launches a plurality of underwater rocket missiles utilizing inflatable bags 30 and a gas bottle 34.

In the Brown reference (U.S. Pat. No. 3,137,203), a launch system is disclosed. The missile launching system operates where a capsule 13 containing the missile 14 is ejected from a vertical tube 11 of a missile launching submarine. As the capsule 13 leaves the tube 11, a tube 17 is inflated from a supply of air under pressure from accumulators 18.

An improvement to existing launching technology would be to provide a capsule that is not significantly larger that the size of the contents of the capsule yet can provide the necessary buoyancy to launch the contents (such as weapons and vehicles). The capsule would telescope a portion of the capsule that completely surrounds the weapon with the portion able to increase the buoyancy of the capsule with the minimal use of gas generation at launch. A launch capsule that minimizes gas generation and use stowage space would be a significant improvement over existing launch capsules.

SUMMARY OF THE INVENTION

It is therefore a general purpose and primary object of the present invention to provide a telescoping capsule that in a stowage state is near in size to the weapon/vehicle that the capsule contains but when activated for launch extends in length to create the necessary buoyancy for a successful deployment.

It is a further object of the present invention to provide a capsule that is stored in a collapsed or unextended state in order to save space.

It is a still further object of the present invention to provide a capsule that is stored in a collapsed or unextended state in order to save space therefore allowing storage space within the payload module to be conserved.

It is a still further object of the present invention to provide a capsule in which launch depth capability is improved by minimizing the size of the protective capsule while maintaining a given wall thickness of comparatively larger capsules.

It is a still further object of the present invention to provide a capsule that minimizes gas generation for launching weapons.

To attain the objects described, there is provided a telescoping capsule adaptable to be as part of a larger modular payload bay. The telescoping buoyancy capsule is preferably a rigid cylindrical body sized to contain a vehicle or weapon and is designed to withstand depth pressures. The rigid cylindrical body of the capsule also protects the weapon during an ascent to the water surface. Once the surface is reached, a nose cone of the capsule is jettisoned to allow the weapon to exit the capsule.

A telescoping nose section allows the volume of the capsule section to be minimized for maximum packing density and allows the volume of the capsule to be increased without increasing the weight of the capsule. The telescoping nose section normally remains unextended around the weapon contained within the capsule. However when extended, the greater volume of the extended telescoping nose section provides the necessary buoyancy used to lift the capsule out of a stored state and to ascent the capsule towards the surface.

When the capsule is positioned in a stowage location, the capsule is secured by a latching mechanism which maintains the telescoping nose section in an unextended or collapsed state. The latching mechanism prevents the telescoping nose section from extending until a launch/deployment is initiated. When the latching mechanism is activated to release, the telescoping nose section is free to extend.

Once the capsule is loaded into its stowage location and the telescoping nose section is properly latched, the capsule is pressurized at a pressurization valve. The pressurization valve provided on the nose cone pressurizes the capsule with air or an inert gas, based upon the launch requirements of the capsule. In order for the telescoping nose section to extend, the pressure inside the capsule must be set to a greater pressure than what is anticipated at the launch depth. The capsule must be adequately pressurized to overcome pressure at the launch depth and all the frictional forces that act on the capsule.

A high pressure air flask is integrated in the capsule to add a small amount of air to compensate for what little may leak past the seals of the capsule. The capsule should already be pressurized through the pressurization valve when the capsule is initially installed within the telescoping buoyancy capsule system.

In operation, once the modular payload bay door of a submarine is opened, the telescoping buoyancy capsule is extended to raise the weapon out of the submarine and into the seawater environment. In the seawater environment, the telescoping buoyancy capsule ascends to the surface for a dry weapon/vehicle launch. After the telescoping capsule is sufficiently stabilized, the nose cone is jettisoned and the propulsion system of the weapon is activated to fly the weapon out of the telescoping buoyancy capsule and toward a target.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
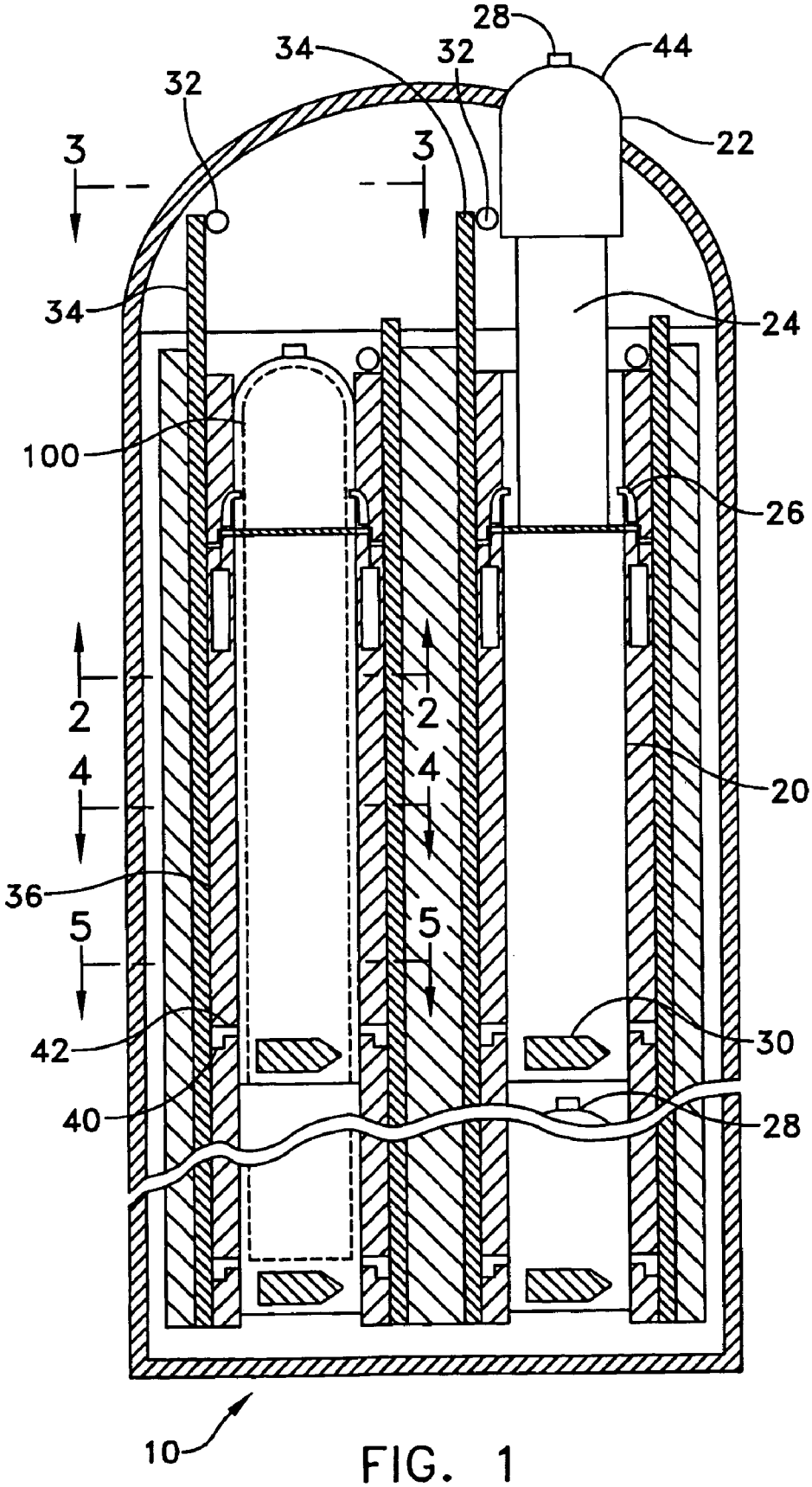
FIG. 1 shows a cross-sectional view of a telescoping buoyancy capsule of the present invention.

Referring now to the drawings in detail wherein like numerals indicate like elements throughout the several views, the telescoping buoyancy capsule system 10 of the present invention is shown in FIG. 1. In use with a submarine or other undersea platform (not shown), a telescoping buoyancy capsule 20 of the telescoping buoyancy capsule system 10 could be built as part of a larger modular payload bay.

The telescoping buoyancy capsule 20 is preferably a rigid cylindrical body sized to contain a vehicle or weapon 100 and is designed to withstand operating depth pressures. The weapon 100 may be many sizes, know to those skilled in the art and capable of utilizing the buoyancy that the telescoping buoyancy capsule system 10 provides. The rigid cylindrical body of the capsule 20 also protects the weapon 100 during an ascent to the water surface. Once the surface is reached, a nose cone 22 of the capsule 20 is jettisoned or separates to allow the weapon 100 to exit the capsule.

The rigid cylindrical body of the capsule 20 also protects the weapon 100 from the corrosive seawater environment as the weapon remains dormant. If the capsule 20 is contained inside a larger watertight container such as a launch tube commonly used on submarines, the capsule does not require the same structural robustness. The large watertight container would provide protection at full operational depths, while the capsule 20 need only provide protection at the designated launch depth. When the large container is flooded to equalize pressure with ambient ocean surroundings, the capsule 20 protects the weapon 100 contained inside, such that the capsule gets wet each time the large container is flooded, but contents of the capsule do not.

A telescoping nose section 24 allows the volume of the capsule 20 to be minimized for maximum packing density and allows the volume of the capsule to be increased without increasing the weight of the capsule. The telescoping nose section 24 normally remains unextended around the weapon 100 contained within the capsule. However when extended, the greater volume of the extended telescoping nose section 24 provides the necessary buoyancy used to lift the capsule 20 out of a stored state and to ascent the capsule towards the surface.

Figure 2:
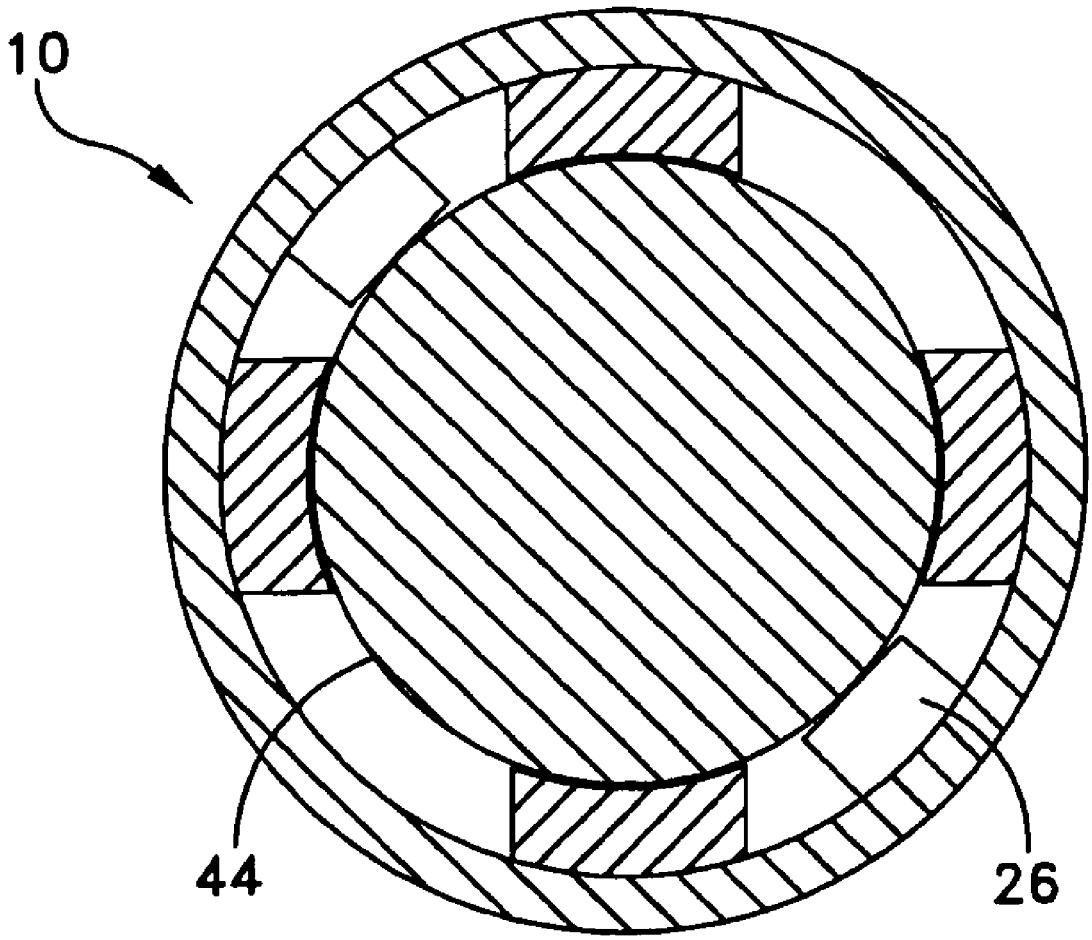
FIG. 2 shows an alternate cross-sectional view depicting the capsule release devices of the telescoping buoyancy capsule with the view taken from reference line 2—2 of FIG. 1.

When the capsule 20 is positioned in a stowage location, the capsule is secured by a latching mechanism 26 which maintains the telescoping nose section 24 in an unextended or collapsed state. The latching mechanism 26 (also shown in FIG. 2) prevents the telescoping nose section 24 from extending until a launch/deployment is initiated. When the latching mechanism 26 is activated to release, the telescoping nose section 24 is free to extend. Only hydrostatic depth pressure and friction opposes the extension of the telescoping nose section 24, once the latching mechanism 26 is activated and the telescoping nose section is released.

Once the capsule 20 is a stowage location and the telescoping nose section 24 is properly latched, the capsule 20 is pressurized at a pressurization valve 28. The pressurization valve 28 is provided on the nose cone 22 to pressurize the capsule 20 with air or an inert gas, based upon the launch requirements of the capsule. In order for the telescoping nose section 24 to extend, the pressure inside the capsule 20 must be set to a greater pressure than what is anticipated at the launch depth. The capsule 20 must be adequately pressurized to overcome pressure at the launch depth and all the frictional forces that act on the capsule.

A high pressure air flask 30 is integrated in the capsule 20 to add a small amount of air to compensate for what little may leak past the seals of the capsule. Alternatively for capsules used for smaller weapons, air can be provided from outside of the capsule. The capsule 20 should already be pressurized through the pressurization valve 28 when the capsule is initially installed within the telescoping buoyancy capsule system 10.

Figure 3:
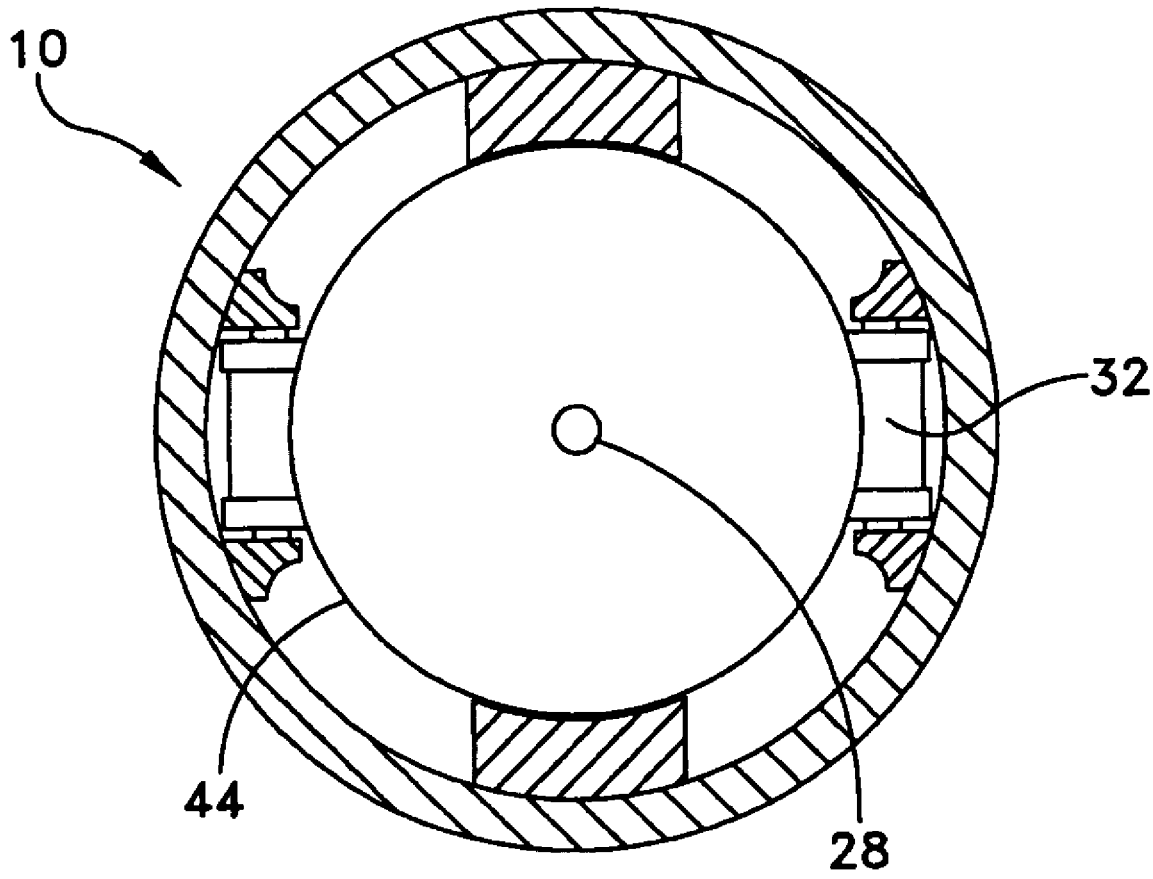
FIG. 3 shows an alternate cross-sectional view depicting the roller arrangement of the telescoping buoyancy capsule with the view taken from reference line 3—3 of FIG. 1.

Rollers 32 are placed at the top of a launch tube 34 of the telescoping buoyancy capsule system 10. The rollers 32 (also shown in FIG. 3) help to reduce friction on the capsule 20; which otherwise opposes the ascent of the capsule. The rollers 32 also help minimize the bending force placed on the capsule 20 as the capsule extends out into the flow field around the submarine.

Figure 4:
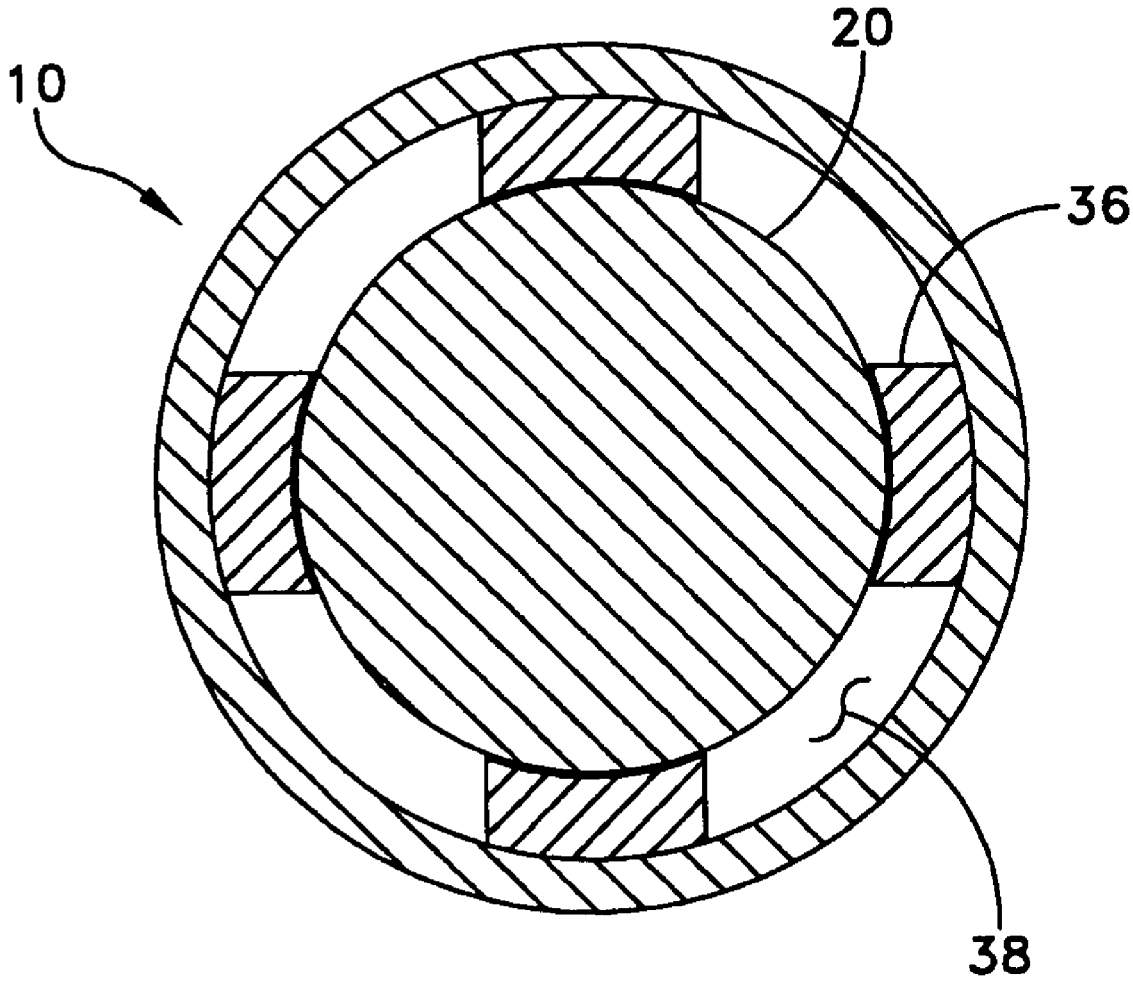
FIG. 4 shows an alternate cross-sectional view depicting the guide rails of the telescoping buoyancy capsule with the view taken from reference line 4—4 of FIG. 1.

The telescoping buoyancy capsule system 10 also includes guide rails 36 are used to help stabilize the capsule 20 and protect the capsule from shock events. The guide rails 36 (also shown in FIG. 4) are compliant in which the compliantness assists in releasing the capsule 20 during a launch. Since the guide rails 36 are compliant and depth pressure sensitive, the guide rails can be properly sized to grip the capsule 20 under atmospheric or low pressures, but then lessen or release their grip at higher launch depth pressures. The guide rails 36 also define annular flow gaps 38 such that as the capsule 20 ascends, seawater is drawn in through the annular flow gaps, filling in behind the capsule as the capsule is displaced upwards. The compliant material is rubberized or includes properties known to those skilled in the art that would make the material compliant.

Figure 5:
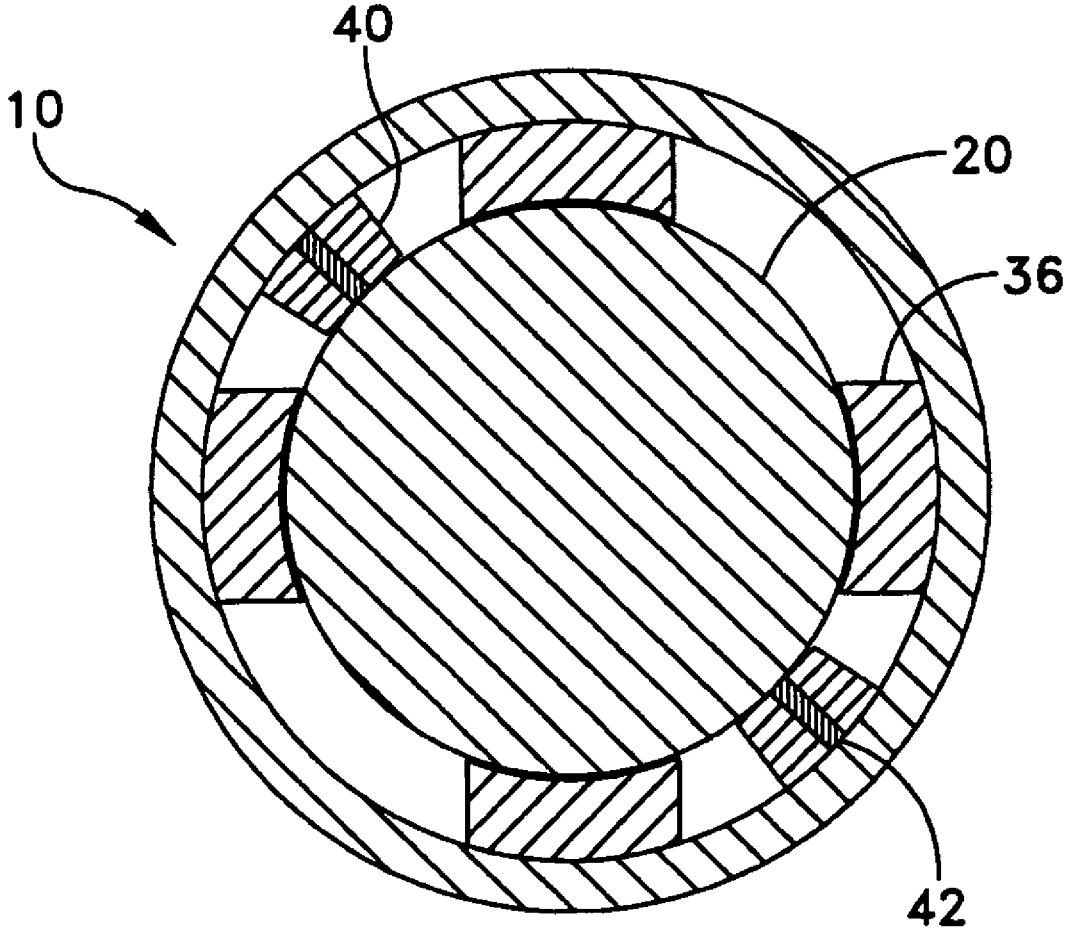
FIG. 5 shows an alternate cross-sectional view depicting the capsule supports of the telescoping buoyancy capsule with the view taken from reference line 5—5 of FIG. 1.

At least one capsule support 40 is positioned at the base of the capsule and attached to the walls of the launch tube 34. The capsule 20 contains a hinged and self-folding capsule support portion 42. The capsule support portion 42 (also shown in FIG. 5) folds in one direction only, since the capsule support portion must support the capsule 20 in the other direction. As soon as the capsule 20 lifts off the capsule support portion 42, the hinged capsule support portion folds down, out of the way, to prevent the capsule support portion from interfering with the ascent of the capsule. The mating capsule support 40 remains stationary attached to the walls of the launch tube 34.

In operation, once the modular payload bay door of a submarine is opened, the telescoping buoyancy capsule 20 is extended to raise the weapon 100 out of the submarine and into the seawater environment. In the seawater environment, the telescoping buoyancy capsule 20 ascends to the surface for a dry weapon/vehicle launch. After the telescoping capsule 20 is sufficiently stabilized, the nose cone 22 is jettisoned and the propulsion system of the weapon 100 is activated to fly the weapon out of the telescoping buoyancy capsule 20 and toward a target.

A major feature of the telescoping buoyancy capsule system 10 and the telescoping buoyancy capsule 20 is an unique combination of familiar components. Components are known to exist that would require minor development to adapt them for use in the telescoping buoyancy capsule system 10 and the telescoping buoyancy capsule 20. As a result, none of the individual components require new technology to develop, but as a system and as a individual buoyancy capsule, a new and unique method for launching weapons/vehicles is represented.

The use of the telescoping buoyancy capsule 20 greatly improves the packing density of submarine payloads. Because the volume of the capsule 20 is minimized until a launch is called for, the payloads (or capsules) occupy a minimum amount of space. When collapsed, the capsule 20 must only be large enough to contain the weapon/vehicle that the capsule deploys; thereby, differentiating the capsule design from other capsule designs that have the buoyancy built into the size of the capsule. By utilizing the telescoping nose section 24, the volume required for a buoyant ascent is not required until an actual launched is call for. Given a higher packing density of a plurality of the telescoping buoyancy capsules 20 of the present invention, either more weapons/vehicle can be carried on the same size submarine, or the same number of weapons can be carried on a smaller submarine.

Also, capsule stability of the maximized by the telescoping nose section 24. The telescoping nose section 24 ensures that the buoyancy is provided at a top 44 where buoyancy is usually needed the most. Buoyancy at or in proximity to the top 44 ensures that a maximum distance is maintained between the center of gravity and the center of buoyancy of the telescoping buoyancy capsule 20. The distance between the center of gravity and the center of buoyancy of the telescoping buoyancy capsule 20 ensures that the between the center of gravity and the center of buoyancy of the telescoping buoyancy capsule 20 remains upright to be stable during ascent and to be stable on the surface.

Furthermore, the design of the telescoping buoyancy capsule 20 provides for greater safety. Often gas generators are used for energy storage on submarines. However, explosive materials are required with gas generators that place the submarine and crew at greater risk. Gas generators also add complexity and cost to get the system approved. The telescoping buoyancy capsule 20 of the telescoping buoyancy capsule system 10 are suited to use only compressed air. By using compressed air, no volatile materials are necessary. Submarines routinely use compressed air throughout the submarine, so it is a familiar and relatively safe method for storing energy.

Because the telescoping buoyancy capsule 20 is pressurized with air, the telescoping buoyancy capsule has greater depth capacity. The internal air pressure helps to counteract the external hydrostatic water pressures, thereby making the telescoping buoyancy capsule 20 less susceptible to imploding. As a result, the telescoping buoyancy capsule 20 can either be launched at greater depths, or the cylindrical walls of the telescoping buoyancy capsule may be made thinner.

As opposed to having the telescoping buoyancy capsule 20 constantly charged with high-pressure air, large air flasks, gas generators, or air bag inflators could be used to pressurize and extend the telescoping buoyancy capsule when needed. This charging capacity allows the telescoping buoyancy capsule 20 to remain at atmospheric pressure until a launch/deployment is initiated.

Thus, the several aforementioned objects and advantages of the present invention are most effectively attained. Although preferred embodiments of the invention have been disclosed and described in detail herein, it should be understood that this invention is in no sense limited thereby and its scope is to be determined by that of the appended claims.

What is claimed is:

1. A system for launching a vehicle from an undersea platform, said system comprising:

a launch tube;

a cylindrical body positioned with said launch tube, said cylindrical body having a closed first end, sidewalls, and an open second end, the vehicle to be launched being completely positioned within said cylindrical body;

a nose section operationally connected to said cylindrical body at the second end and extendable along a longitudinal axis of said cylindrical body from an interior circumference of said cylindrical body to telescope to an increase in interior volume with a resultant increase in buoyancy of said cylindrical body;

a nose cone attached to an opposite end of said nose section wherein said nose cone is detachable from said cylindrical body upon a communication to launch the vehicle; and at least one latching mechanism secured at one point to said launch tube and detachably secured at a second point to said nose cone such that when both the first and second points are secured said nose section is collapsed into said cylindrical body and when said latching mechanism is detached at the second point said nose section is free to telescope from said cylindrical body.

2. The system in accordance with claim 1, said system further comprising:

a valve positioned on said nose cone, said valve fluidly connectable to a pressurized air source and an interior of said cylindrical body such that the pressurized air from the source pressurizes said cylindrical body to a buoyancy based upon the launch requirements of said cylindrical body.

3. The system in accordance with claim 2, said system further comprising at least one pressurized air flask positioned within said cylindrical body, said pressurized air flask capable of compensating an amount of air within said cylindrical body to achieve the buoyancy based upon the launch requirements of said cylindrical body.

4. The system in accordance with claim 3, said system further comprising a plurality of rollers positioned between a path of said cylindrical body and said launch tube, said rollers capable of reducing friction between said cylindrical body and said launch tube.

5. A device for launching a vehicle from an undersea platform, said device comprising:

a cylindrical body adaptable to a launch tube, said cylindrical body having a closed first end, sidewalls, and an open second end, the vehicle to be launched being completely positioned within said cylindrical body;

a nose section operationally connected to said cylindrical body at the second end and extendable along a longitudinal axis of said cylindrical body from an interior circumference of said cylindrical body to telescope to an increase in interior volume with a resultant increase in buoyancy of said cylindrical body;

a nose cone attached to an opposite end of said nose section wherein said nose cone is detachable from said cylindrical body upon a communication to launch the vehicle; and at least one latching mechanism securable at one point to the launch tube and detachably secured at a second point to said nose cone such that when both the first and second points are secured said nose section is collapsed into said cylindrical body and when said latching mechanism is detached at the second point said nose section is free to telescope from said cylindrical body.

6. The device in accordance with claim 5, said device further comprising:

a valve positioned on said nose cone, said valve fluidly connectable to a pressurized air source and an interior of said cylindrical body such that the pressurized air from the source pressurizes said cylindrical body to a buoyancy based upon the launch requirements of said cylindrical body.

7. The device in accordance with claim 6, said device further comprising:

at least one pressurized air flask positioned within said cylindrical body, said pressurized air flask capable of compensating an amount of air within said cylindrical body to achieve the buoyancy based upon the launch requirements of said cylindrical body.

* * * * *